US005813953A

United States Patent [19]

Whipple

[11] Patent Number: 5,813,953

[45] Date of Patent: Sep. 29, 1998

[54] PORTABLE EXERCISE APPARATUS AND METHOD OF USE

[76] Inventor: David L. Whipple, 7129 San Francisco Rd. NE., Albuquerque, N. Mex. 87109

[21] Appl. No.: 544,849

[22] Filed: Oct. 18, 1995

[51] Int. Cl.[6] ..... A63B 21/055

[52] U.S. Cl. ..... 482/123; 482/130; 482/908

[58] Field of Search ..... 482/91, 92, 121–123, 482/126, 129, 130, 133, 142, 908; 190/102, 112

[56] References Cited

U.S. PATENT DOCUMENTS

| | | | |
|---|---|---|---|
| 3,117,781 | 1/1964 | Vargo | 482/91 |
| 3,664,666 | 5/1972 | Lloyd | 482/133 |
| 3,828,899 | 8/1974 | Scott . | |
| 3,893,667 | 7/1975 | Snyder, Jr. et al. | 482/123 |
| 3,995,853 | 12/1976 | Deluty . | |
| 4,410,174 | 10/1983 | Hamada . | |
| 4,478,413 | 10/1984 | Siwula . | |
| 4,620,704 | 11/1986 | Shifferaw . | |
| 4,645,204 | 2/1987 | Berger . | |
| 4,725,057 | 2/1988 | Shifferaw . | |
| 4,756,527 | 7/1988 | Ledbetter . | |
| 4,779,866 | 10/1988 | Marshall et al. . | |
| 4,856,775 | 8/1989 | Colledge et al. | 482/142 |
| 4,871,165 | 10/1989 | Marshall et al. . | |
| 4,944,511 | 7/1990 | Francis . | |
| 5,322,490 | 6/1994 | Van Der Hoeven | 482/52 |
| 5,524,893 | 6/1996 | McGinnis et al. | 482/129 |
| 5,586,962 | 12/1996 | Hallmark | 482/129 |

FOREIGN PATENT DOCUMENTS

| | | | |
|---|---|---|---|
| 2031740 | 4/1980 | United Kingdom | 482/123 |

OTHER PUBLICATIONS

Lifeline Gym, advertisement in "Bicycling", p. 82, Jan. 1985.

Stepshaper, Owner's Manual, WESLO, Logan, Utah, 1992.

*Primary Examiner*—Richard J. Apley
*Assistant Examiner*—Victor K. Hwang
*Attorney, Agent, or Firm*—Leo F. Costello

[57] ABSTRACT

An apparatus for performing exercises including a case for transporting the exercise device and for use in performing the exercises. The case can be a simulated briefcase, so that the exercise device can be carried around like ordinary luggage, or be another type of container. Included are elastic cables which can be moved from stowed positions in the case to exercising positions in which portions of the cables extend outwardly from the case. The portions of the cables remaining in the case are restrained against stretching thereby allowing essentially only the portions of the cables extending outwardly from the case to be stretched. In performing exercises, the outwardly extending portions of the cables are pulled against the case, thereby setting up forces which resist the pulling action and enable the desired strength training. It is possible to exercise all of the major muscle groups and to replicate the exercises performed on popular stationary exercise apparatus. An important feature is the ability to select and use several different strength levels by inserting reels with cables of different stretch characteristics which thereby change the forces required to stretch the cables.

28 Claims, 6 Drawing Sheets

PORTABLE EXERCISE APPARATUS AND METHOD OF USE

FIELD OF THE INVENTION

This invention pertains to a portable exercise apparatus and method of use and more particularly to an exercise apparatus that includes a case for use in transporting the apparatus and in performing exercises, and to a method of performing exercises with the apparatus.

BACKGROUND

The value of obtaining regular physical exercise is constantly stressed. Both cardiovascular and resistance or isometric exercise are important to physical and mental well-being. Unfortunately, however, following an exercise regimen is difficult for most people. Often, those who most need such exercise are in sedentary occupations, such as professional and business persons, and they are more likely to find it difficult to adhere to an exercise program.

Nevertheless, those who are dedicated to a weekly schedule of workouts may belong to health clubs or may invest in one or more of the many excellent types of exercise machines which are commercially available today for home installation and use. These machines range from large, complex apparatus with weights, pulleys and cables and multiple workout stations, like NAUTILUS machines, to less bulky but still stationary machines using resilient rods or elastic bands and essentially one workout station, like the BOWFLEX machine, to more specialized equipment which concentrate on limited muscle groups but still may not be compact enough to be portable.

Even the dedicated individuals who use health clubs or invest in home exercise equipment and embark on a planned exercise program, however, are frustrated and discouraged when they must interrupt their weekly workout routine because of travel requirements or desires. Not only business and professional people are affected here, but retirees and many others. A few days, a week, or more of absence from workouts may mean a setback in a routine and, for many, a total break in a newly developed habit.

Portable exercise devices have been developed in an effort to satisfy such needs of those who want to workout while traveling or when otherwise away from their home-based equipment. The known portable devices, however, lack certain features desirable in such portable equipment. Such a portable device needs to be easy to use, to carry, check-in, or store, and otherwise be compatible with ordinary luggage. Many people would prefer that their portable exerciser be unobtrusive and look like regular luggage. Since the device will probably be used in a hotel or motel room in the evenings, it must be simple and not subject to breakdown or need for repair. Of prime significance, the portable device should be compatible with home-based or health club equipment, such as NAUTILUS equipment or the BOWFLEX "Power Pro" Strength Training System disclosed in U.S. Pat. No. 4,620,704, and ideally should enable the same or similar workouts as are performed at home or the club so that the exercise routine can continue uninterrupted.

SUMMARY

The present invention is directed to an apparatus and method for performing exercises which includes a case or container for transporting the exercise apparatus and for use in performing the exercises. The case is preferably a briefcase, so that the apparatus can be carried around like ordinary luggage, but it can be another type of container for housing, carrying, and using the apparatus. The apparatus includes elastic cables housed within the case and movable from stowed positions in the case to exercising positions in which portions of the cables extend outwardly from the case. The apparatus restrains movement of the portions of the cables remaining in the case thereby allowing essentially only the portions of the cables extending outwardly from the case to be stretched. In performing exercises, the outwardly extending portions of the cables are pulled against the case, thereby setting up resilient forces which resist the pulling action and enable the desired strength training. With the subject apparatus it is possible to exercise all of the major muscle groups and to replicate the exercises performed on popular stationary exercise apparatus. An important feature of the invention is the ability to select and use different strength levels which is accomplished by providing cables of different elasticities which thereby change the forces required to stretch the cables.

An object of the present invention is provide a portable exercise apparatus that provides several improvements over known portable exercise devices.

Another object is to provide a highly functional and versatile portable exercise device particularly suited to the person who wishes to maintain a regular workout schedule but is often unable to do so because of the need to travel away from home or health-club based stationary exercise equipment.

Another object is to provide a portable exercise apparatus in a case which resembles a briefcase and which can be carried, checked in, or stored like ordinary luggage.

Another object is to enable the performance on a portable exercise apparatus of a high number of well-established exercises capable of exercising the major muscle groups of the body.

A further object is to replicate on a portable exercise apparatus all the exercises that are normally performed on a stationary exercise apparatus.

A still further object is to provide selectively usable, optional strength levels in a portable exercise device.

Yet another object is to house an exercise device in a simulated briefcase which forms part of, and functions with, the exercise apparatus.

A feature of the subject apparatus and method is the use of elastic cables of varied elasticities to provide the apparatus with different strength levels.

A further object is to provide a portable exercise apparatus that is simple, economical and easy to maintain and use.

DETAILED DESCRIPTION

Figure 1:
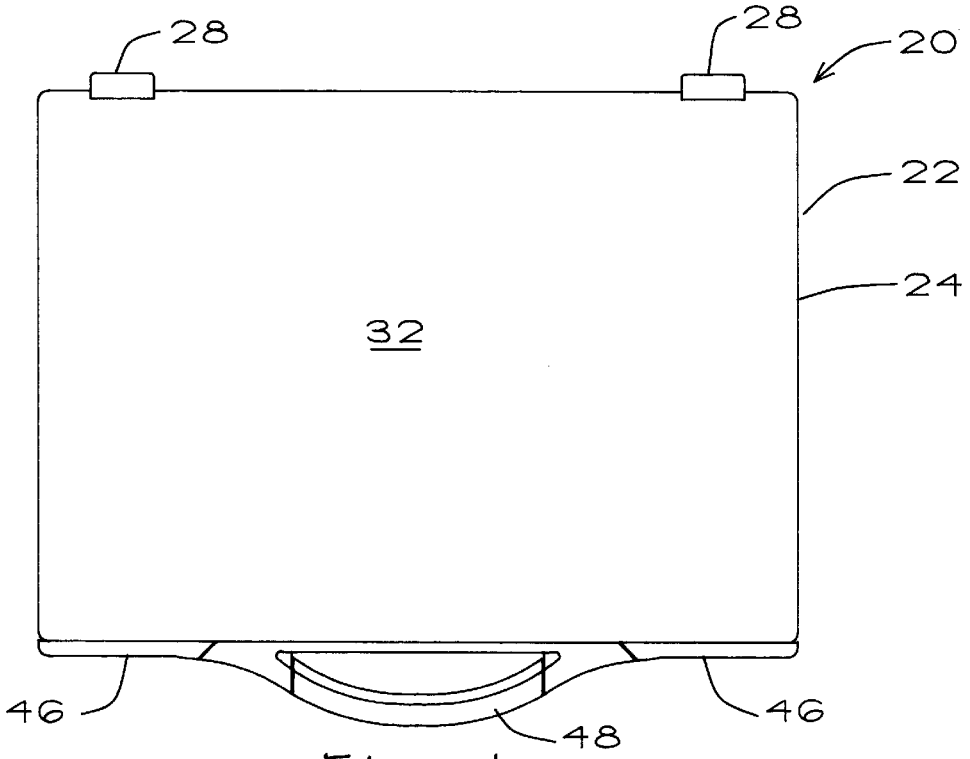
FIG. 1 is plan view of the preferred embodiment of the portable exercise apparatus of the present invention, showing a closed briefcase which contains other parts of the apparatus.

The portable exercise apparatus of the present invention is best illustrated in FIGS. 1–5 and 8 and is identified by the numeral 20. In the disclosed embodiment, the exercise apparatus includes an outer case or container 22 which in the preferred embodiment is a briefcase. As such, the briefcase is of conventional construction, although slightly modified as described below, and can take the form of various currently available models of briefcases or pieces of luggage. For example, the briefcase manufactured by the Samsonite Corporation of Denver, Colo., under the trademark Focus®, with the minor modifications, may be used. Although the basic construction of the briefcase is conventional, these modifications are preferable to accommodate the principles of the present invention and are discussed below.

In general, the briefcase 22 (FIGS. 1–5) includes substantially identical, hollow, rectangular top and bottom sections 24 and 26, or lid and base, which are interconnected by hinges 28 for movement between open and closed positions. Thus, the top and bottom sections have top and bottom walls 32 and 34, respectively; longitudinal front walls 36; back walls 38; and transverse side walls 40. The briefcase also has a pair of braces 44 for holding the sections in open position, latches 46, and a handle 48. Alternatively, the latches may be eliminated and other means may be employed to hold the top section at a ninety degree angle to the bottom section, or the top and bottom sections may be allowed to open to a one-hundred-eighty degree angle and lie flat on a supporting surface.

The briefcase 22 (FIGS. 1, 2 and 3) is preferably made of a lightweight, strong and durable plastic material, but may also be made of lightweight metal. In the preferred embodiment, however, the top and bottom sections 24 and 26, and thus the walls 32 and 34, are of a rigid plastic material which yields only very slightly when pressure is placed on these walls in the closed position of the briefcase. The side walls are of an even thicker more rigid plastic and preferably incorporate reinforcing rims or frames 50 which circumscribe both the top and bottom sections.

Both the top and bottom sections 24 and 26 (FIGS. 2 and 3) of the briefcase 22 are hollow and do not include dividers for papers, or the like, which are typical in conventional briefcase construction. Thus, each of the top and bottom sections has a cavity 54 which is filled as described below. Another modification of the standard briefcase is that each of the side walls 40 of the bottom section 26 has a front notch 60 with the two notches being aligned across the case.

The exercise apparatus 20 also includes rectangular top and bottom fillers 70 and 72 (FIGS. 2, 3, and 5) which, in the preferred embodiment, serve as a reinforcing insert or inner container in the case 22, or in an alternate embodiment, as an independent container or case for the exercise apparatus. Each of these fillers is preferably a block of hard, rigid, and lightweight material and may be made of various materials such as silicone, ABS, an injection molding plastic, or other material but not limited to plastic as long as the filler selected satisfies the characteristics described herein. The bottom filler block 72 is fitted into the cavity 54 of the bottom section 26, preferably with a snug but releasable fit, but it may be secured in such a position. So located, the bottom filler block 72 has a top surface 74 approximately coplanar with the top edges of the front, back and side walls 36, 38 and 40.

The bottom filler block 72 also includes a central circular recess 76 (FIGS. 2 and 3), a longitudinal front slot 80 tangentially related to the central recess, rear triangular handle recesses 82 on opposite sides of the central recess, and transverse slots 84 interconnecting the handle slots and the front slot. As such, the recesses and slots create a maze of passageways in the top surface 74 of the bottom filler block. It is to be noted that the front slot 80 communicates in the middle with the central recess and has opposite ends 92 which open at the sides of the block and which are in alignment with the front notches 60. Clock face numbers 94 are inscribed on the top surface of the bottom filler block around the central recess.

The top filler block 70 (FIGS. 5 and 6) is fitted in the cavity 54 of the top section 24 of the briefcase 22, and like the bottom filler block 72, may be releasably snugly fitted into position, or secured therein, as desired. In this position, the top filler block has a bottom surface 96 which is approximately coplanar with the bottom edge of the front, back and side walls 36, 38 and 40 of the top section 24. Therefore, when the top and bottom sections 24 and 26 are closed, the bottom surface of the top filler block is in closely spaced relation, or in flush engagement, with the top surface 74 of the bottom filler block. With the briefcase 22 closed, therefore, the fillers or filler blocks provide additional strength and rigidity to the briefcase with regard to forces applied perpendicularly to the top and bottom walls 32 and 34. Irrespective of possible yielding of the top and bottom walls absent the filler blocks, the briefcase is substantially unyielding to several hundred pounds of pressure imposed perpendicularly against the top or bottom walls with the filler blocks in place.

The subject exercise apparatus 20 also includes a circular reel, pulley or spool 100 (FIGS. 2, 5 and 6) having a central hub 101 and including a top sheave 102 and a bottom sheave 104 which are coaxially connected in fixed relation to each other around the hub. The reel thus provides a lower disc 106, a middle disc 108 and a top disc 110 which together with the hub define the sheaves. The top disc has a plurality, preferably three, radial ribs, splines, or lugs 112 projecting upwardly therefrom and equally spaced angularly of the disc, with one of the ribs being an indicator rib **112*i* and identified as such by coloring or anodizing. A stub shaft 114 is fixed centrally on the bottom wall 34 of the bottom section 26 and projects upwardly coaxially of the central recess 76 in the bottom filler block 72. The reel is releasably fitted in the central recess 76 of the bottom filler block 72 with the hub rotatably receiving the shaft 114. The axial length of the reel is approximately equal to the depth of the recess, and the diameter of the reel is slightly less than the diameter of the central recess so as to allow for rotational movement of the reel in the recess while confining its movement transversely of the recess. For reasons to be explained, by manually rotating the reel in the recess, the indicator rib 112***i* can be adjusted to point to any one of the clock face numbers 94.

The apparatus 20 also includes a circular disc brake 120 (FIG. 5) centrally mounted in the top filler block 70. This disc brake may be incorporated, that is molded for example, as part of the top filler block or it may be a separate piece securely fastened to the block. In any event, the disc brake is stationary relative to the top filler block. The disc brake is substantially coplanar with the bottom surface 96 of the top filler block and has a plurality of radial grooves 122 equally angularly spaced therein. In the preferred embodiment disclosed, there are twelve grooves located in the positions of the numbers of a clock face. The grooves have shapes complementary to the ribs 112 but are slightly larger than the ribs. When the briefcase is closed and the filler blocks 70 and 72 are face-to-face, and preferably in engagement or very nearly so (FIG. 8), the disc brake and the reel 100 are coaxial, and the ribs 112 on the reel are positioned to slide into three similarly spaced grooves 122 on the disc brake when the ribs are aligned with such grooves. If three of the grooves are not aligned with the ribs when the case is closed, such alignment will occur upon slight rotational movement of the reel in a manner to be described. If preferred, before closing the case, a user may adjust the reel 100 so that the indicator rib 112*i* is in a twelve o'clock position whereby when the case is closed, the ribs will be positioned to immediately receive the grooves at the twelve o'clock, four o'clock and eight o'clock positions.

A pair of elastic cables 140 (FIGS. 2, 3, 5, and 8) is wrapped or wound in the same direction around the top and bottom sheaves 102 and 104 of the reel 100. These cables are preferably tubular and, as such, a preferred cable is surgical cord made of latex gum rubber which can be obtained from the Amazon Hose and Rubber Company at 130 Jefferson Street, Chicago, Ill. 60606, in their 1992 catalog, page 22. Each tubular cable thus has an inner portion 144 terminating in an inner end 146 connected to the hub 101 and an outer portion 148 terminating in an outer end 150. The reference here to "inner" and "outer" portions is not intended to mean discrete or fixed segments of the cables, but to indicate the relative locations of segments of the cables with regard to the reel and the case 22 in the various positions of the apparatus, as will be more fully explained.

Figures 8A, 8B, 8C:
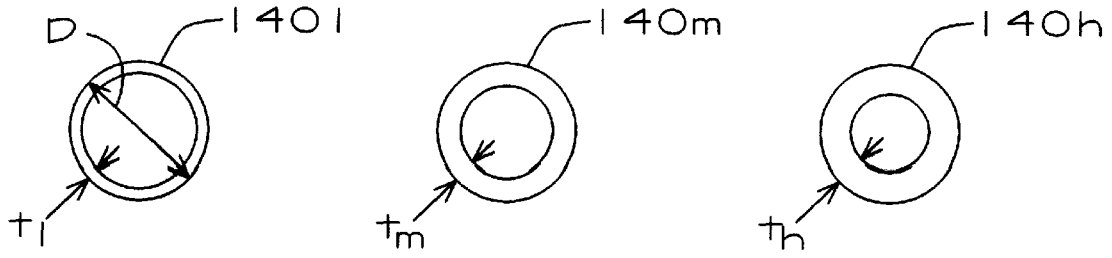
FIGS. 8 *a, b* and *c* show cross sections of the tubular cable used in the preferred embodiment of the present invention and illustrate three different wall thicknesses of this cable corresponding to different strength levels that can be obtained by using the subject apparatus.

In accordance with the principles of the present invention, elastic cables 140 with several different stretch constants are provided. In the disclosed embodiment, this difference in stretchability is accomplished with several (three in the disclosed embodiment) different sizes of cables 140 (FIG. 8). More specifically, using the preferred tubular cable, FIG. 8*a* shows a light workout cable 140*l* having a minimum wall thickness $t_1$ and being relatively easy to stretch; FIG. 8*b* shows a medium workout cable 140*m* having an intermediate wall thickness $t_m$ and requiring greater force to stretch than the cable 1401; and FIG. 8*c* shows a heavy workout cable 140*h* having an even thicker wall thickness $t_h$ and being the most difficult to stretch of the three choices. In each case, however, the outside diameter D of each cable is the same. Although not shown, the present invention provides multiple separate reels 100, three in the preferred embodiment, each having its set of cables, as 140*l*, 140*m*, and 140*h*, for the separate workout levels, three such levels in the present instance. Since the outside diameter of the cables is the same, the same size of reel is used for all three workout levels.

Figure 7:
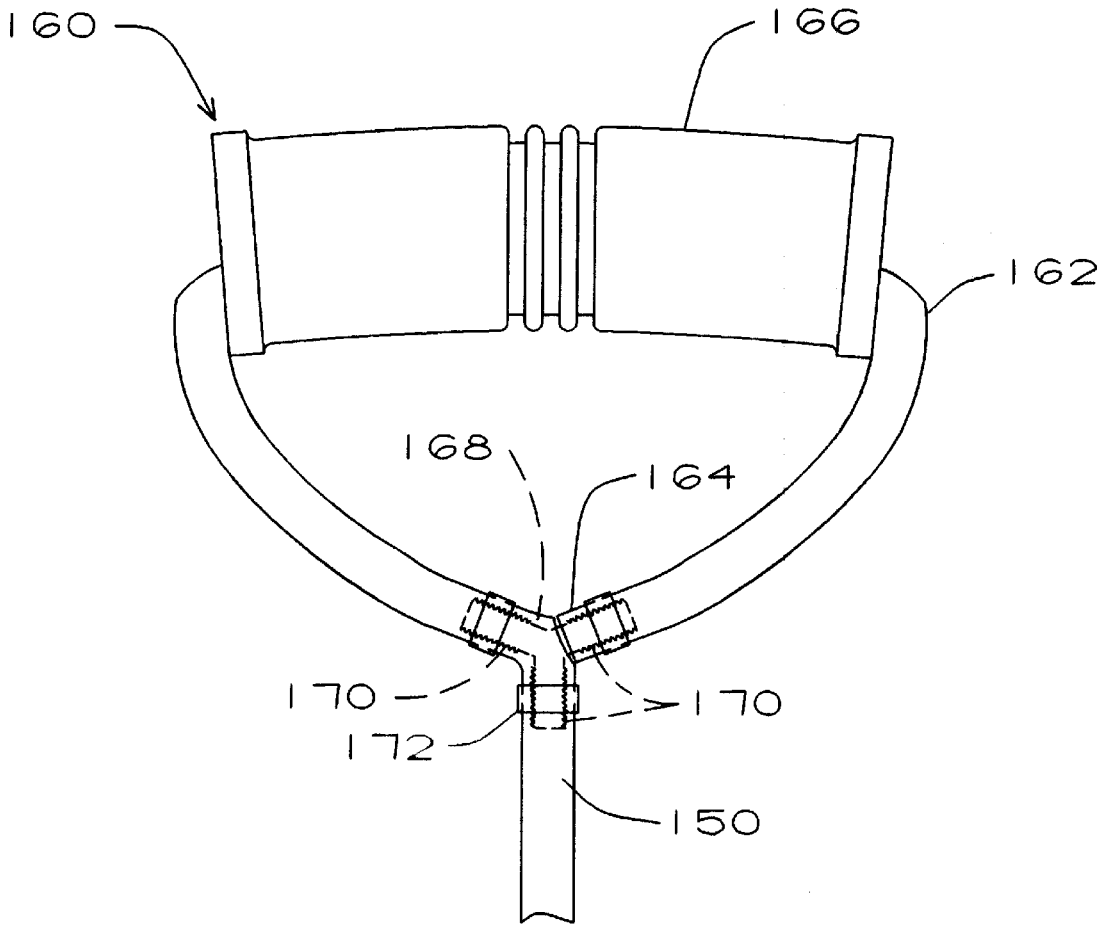
FIG. 7 is a fragmentary detail view of one of the handles on the cables.

As stated, the elastic cable 140 (FIGS. 7 and 8) is preferably tubular and the specific preference is surgical cord, but other shapes, configurations and types of elastic or resiliently stretchable members could be used without departing from the scope of the present invention. For example, the elastic cable may be a solid elastic cord such as a bungee cord, a solid flat or hollow elastic band, or even a spring covered by suitable material although the latter is a far less desirable choice.

The subject apparatus 20 also provides a handle 160 (FIGS. 2–4 and 7) at the outer end 150 of each cable 140. Each handle includes a loop 162 which in the disclosed embodiment is a reversely bent extension of its associated cable 140. The loops define junctures 164 at the outer ends 150 of the cables, and tubular gripping sleeves 166 are fitted over the loops opposite to their junctures, Each loop is maintained by a Y-shaped fitting 168 (FIG. 7) having three barbed arms 170. Two barbed arms are squeezed into the tubular cable through a hole cut in its side at the juncture and the third arm is fitted into the terminal end of the cable. The fitting is bonded in the tubing by a suitable bonding agent, and as an optional fastening means, clamps 172 can be placed around the cable to clamp the cable to the arms of the fitting.

Figure 2:
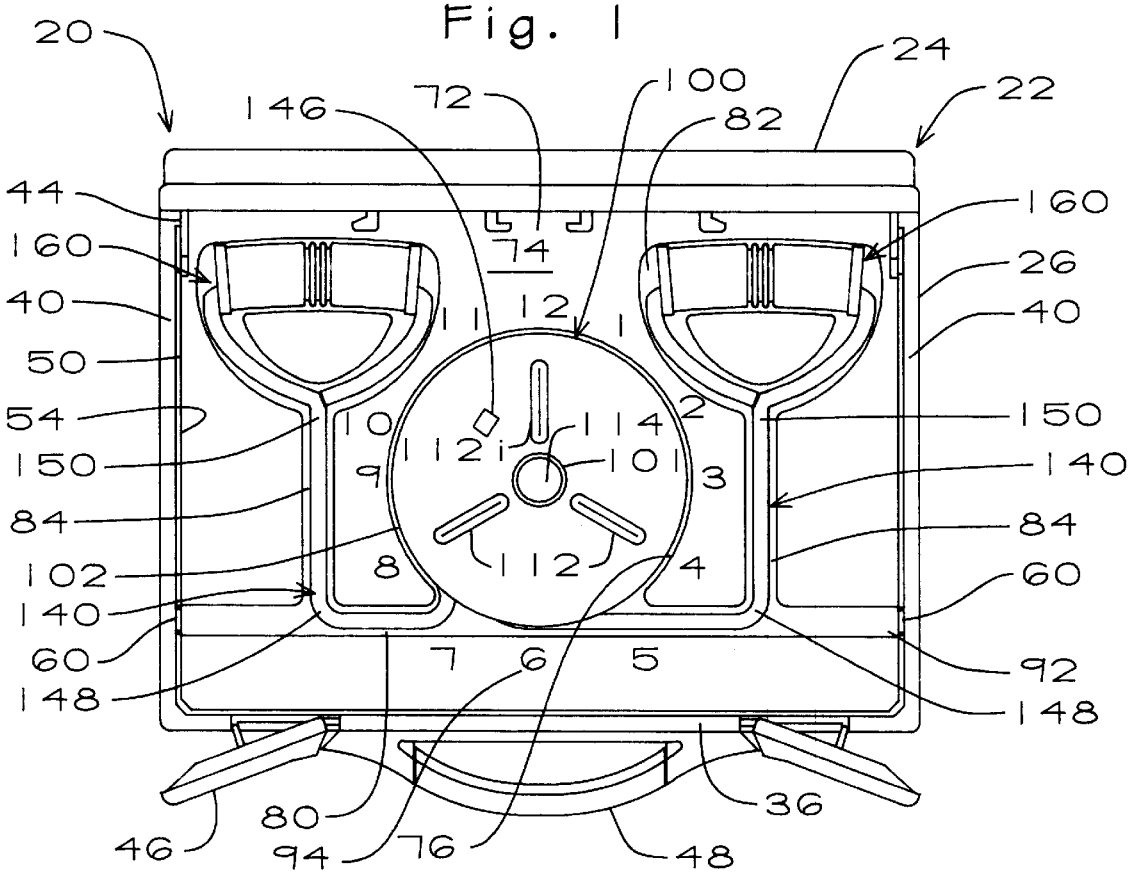
FIG. 2 is also a plan view of the exercise apparatus but with the briefcase in open position and showing a reel and cable assembly, including handles on the cables, in stowed position.
Figure 6:
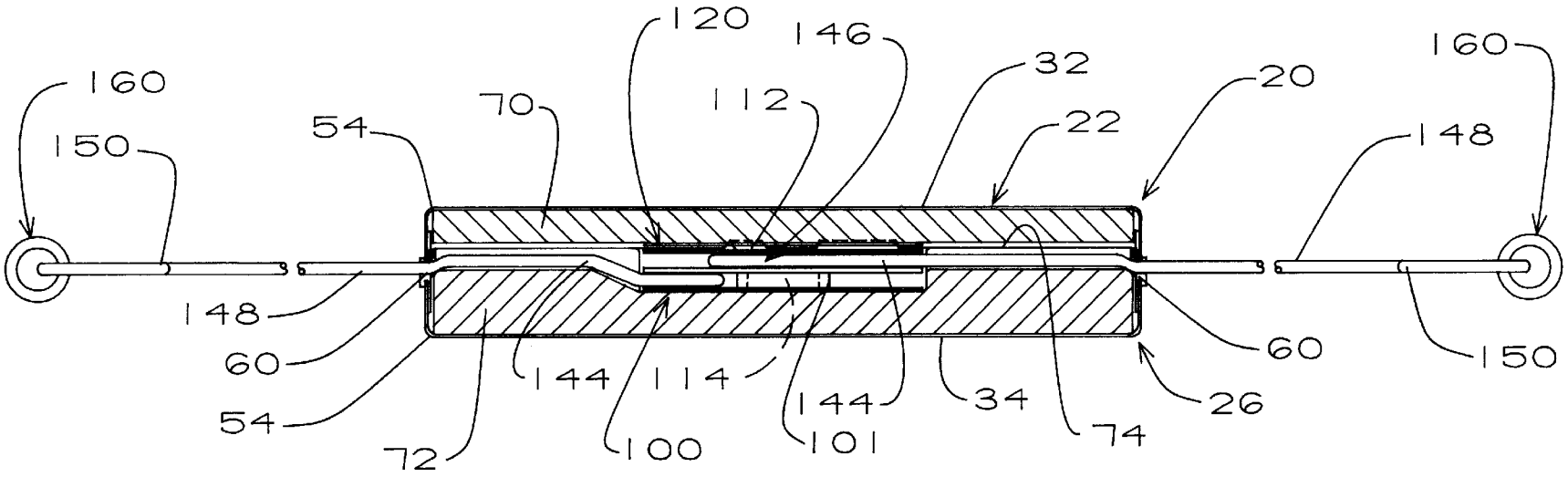
FIG. 6 is a longitudinal vertical section taken along line 6—6 in FIG. 4, showing the case in closed position, with parts broken away, and with the cables in their exercising position but foreshortened as in other views.

In use of the subject portable exercise apparatus 20 and method, and with initial reference to FIG. 2, the cables 140 are shown in their stowed positions. In the stowed position, the handles 160 are fitted in the handle recesses 82, and the outer portions 148 of the cables, that is, the portions of the cables off the reel 100, extend from the reel through the front slots 80 and the transverse slots 84 to the handle recesses. As such, the handles and the cables are all below the top surface 74 of the bottom filler block 72, and only the ribs 112 on the reel project slightly above this top surface (FIG. 6). For purposes of storing or transporting the apparatus 20, the briefcase 22 is closed and latched whereupon the top filler block 70 engages or is very close to the bottom filler block 72 and the ribs 112 fit in aligned grooves 122. Thus, the reel, cables and handles are maintained in their respective recesses and slots. Also, in this stowed position, the outer portions 148 of the cables together with the handles are of equal lengths.

Figure 3:
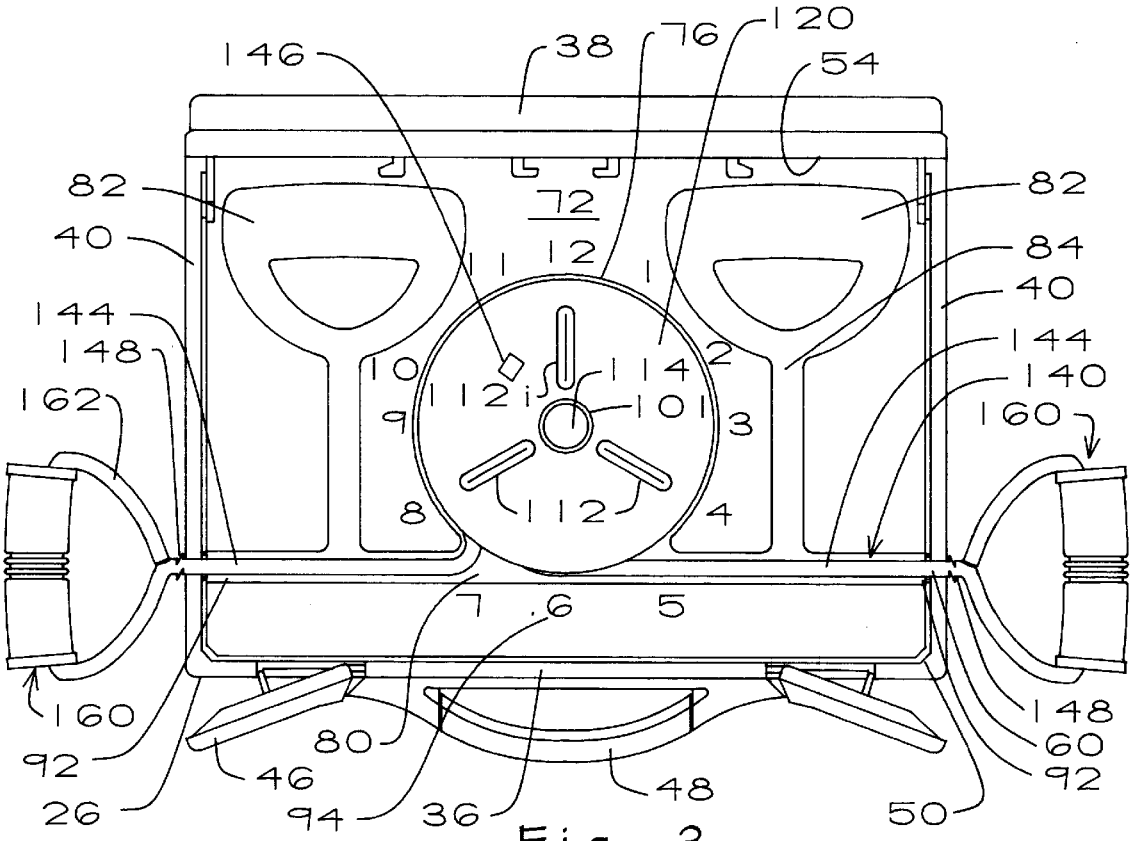
FIG. 3 is a view similar to FIG. 2 with the cables and handles extended laterally out of the case, the portions of the cables outside of the case being foreshortened to fit on the drawing sheet.
Figure 4:
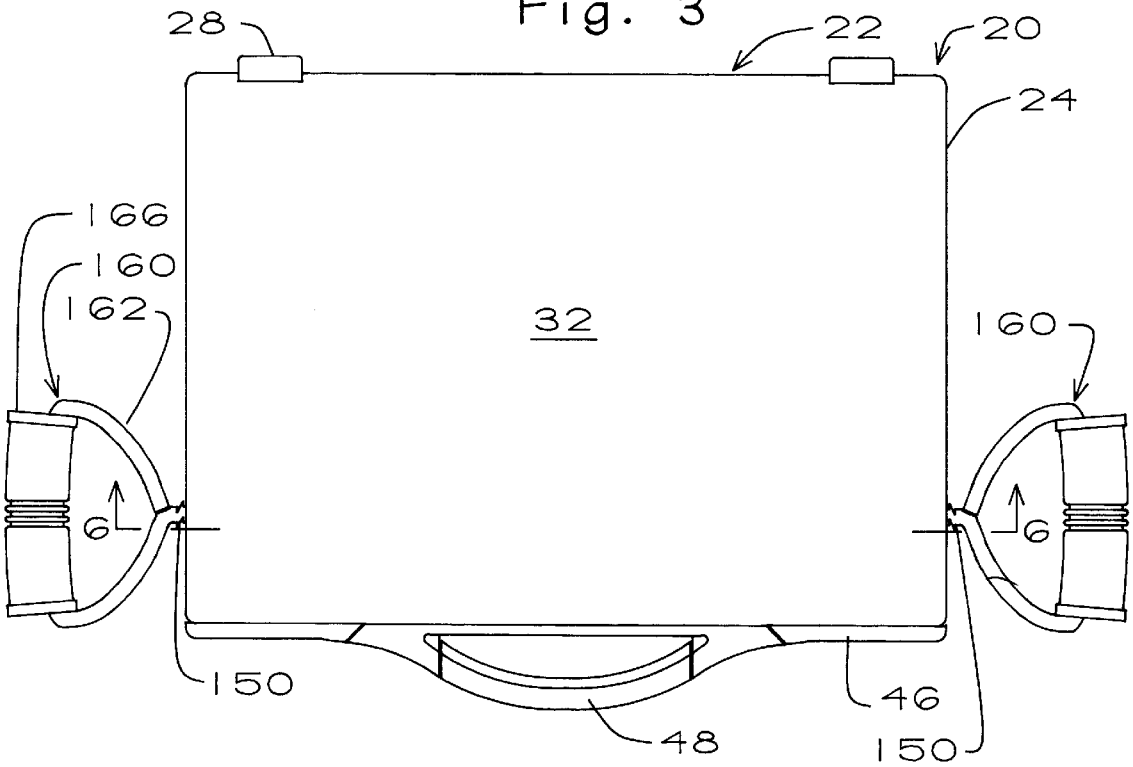
FIG. 4 is a plan view of the briefcase in closed position, similar to FIG. 1, but with the cables and handles outside of the case in their exercising position, the cables being foreshortened.
Figure 5:
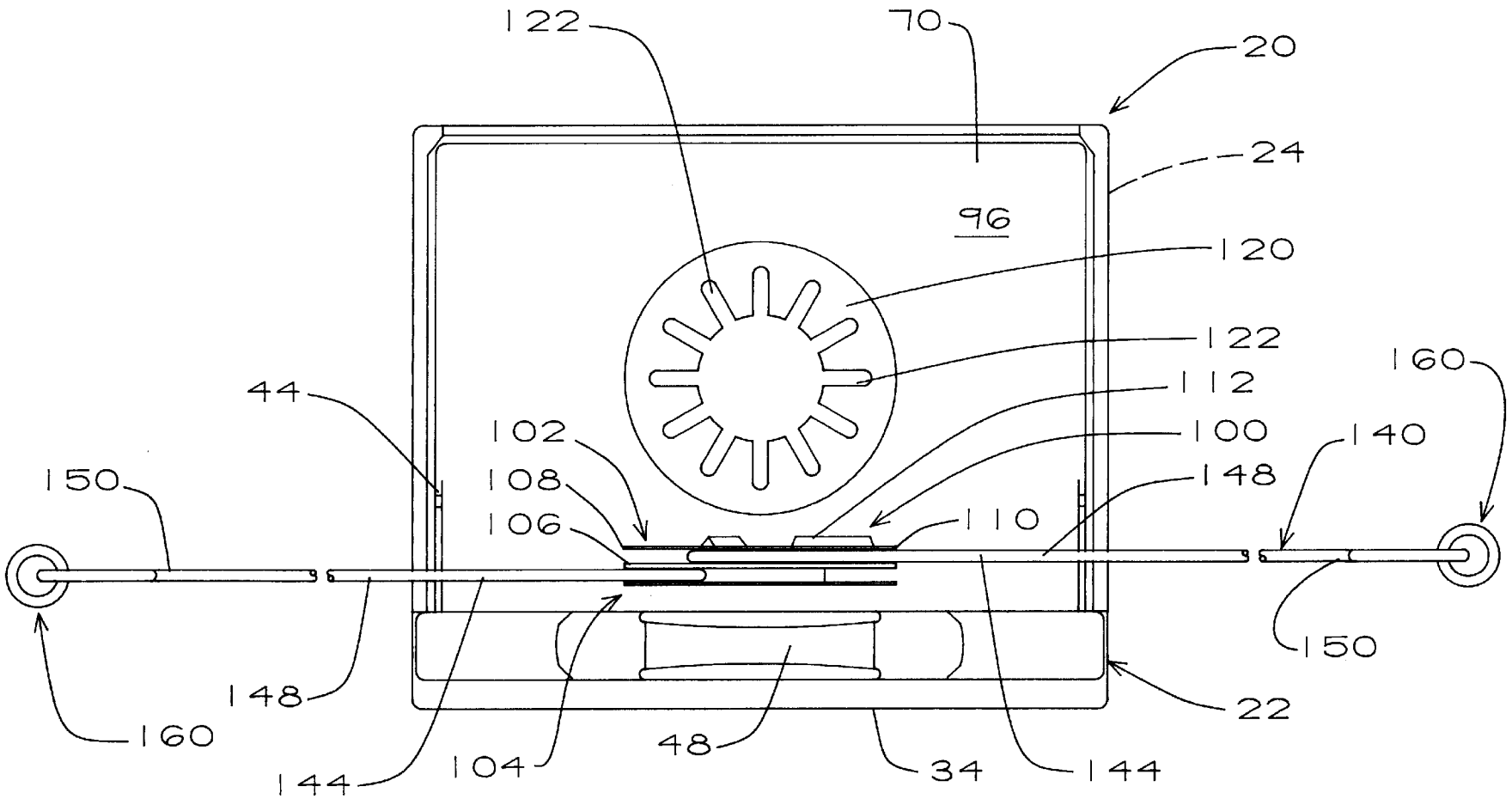
FIG. 5 is a front elevation of the case in open position showing the reel and cable assembly in an exploded position above its normal position in the case and with the portions of the cables outside of the case foreshortened.

The handles 160 and cables 140 also have an exercising position, as illustrated in FIGS. 3, 4, and 5 and in FIGS. 10–16. To go to this exercising position from the stowed position of FIG. 2, the case 22 is opened, and the handles 160 and outer portions 148 of the cables are removed from their recesses 82 and slots 84 and extended outwardly over the bottom side walls 40 of the case. To move the cables between the stowed position and the exercising position, they are pulled outwardly in opposite directions from the reel 100 which is thereby rotated in the central recess 76 and around the shaft 114 to allow such movement. The amount that the cables are extended outwardly from the briefcase 22 depends on the exercise to be performed and the person performing it, as will be explained more fully below.

After the cables 140 are extended the desired lengths in their exercising positions (FIGS. 3 and 5), the outer portions 148, which are now much longer than in the stowed positions, are positioned in the front slot 80 and the front notches 60. The top section 24 of the briefcase is then closed (FIG. 6) and latched thereby bringing the grooves 122 of the disc brake 120 into position so that three of the grooves can receive the ribs 112 on the reel 100 and preclude rotation of the reel. Alternatively, before the case is closed, the indicator rib 112*i* may be placed in the twelve o'clock position, as shown in FIGS. 2 and 3, so that when the top section is closed onto the bottom section the ribs will immediately align with three of the grooves. Also, by closing the briefcase, the filler blocks 70 and 72 confine the inner portions 144 of the cables 140, that is the portions between the reel and the side walls 40 of the case 22 in the slot 80 and notches 60, as shown in FIG. 6.

In this exercising position (FIGS. 4 and 6), and in use of the apparatus 20, the handles 160 are grasped and pulled while maintaining the case 22 stationary, as by standing or sitting on it or placing it behind a door. In this manner, the outer portions 148 of the cables 140 between the side walls 40 of the case and the handles can be stretched in order to develop the desired resistance for the exercises to be performed. Since the inner portions 144 of the cables are restrained against any appreciable stretching or lengthwise movement by the interengaging disc brake 120 and reel 100, stretching is limited to the outer portions 148 of the cables.

A feature of this invention is that a user may adjust or set his or her level of strength training by rotating the reel 100 while the case 22 is open to position the indicator rib 112*i* so that it points at a selected number of the clock face numbers 94. As will be understood, assuming a given height and arm length of the user, the amount of resistance exhibited by the cables 140 in their exercising positions depends on the length of the outer portions 148 of the cables in the exercising position of the apparatus 20. This length may be shortened by reeling in the cables or lengthened by paying out the cables. After a person has used the apparatus for a period of time, he or she can determine how much resistance is preferred and can set the indicator rib at the number 94 which will provide the desired length of the outer portions of the cables.

As previously alluded to, the subject invention allows for several different strength levels of exercise, three such levels in the preferred embodiment. Thus, prior to beginning an exercise regimen, one of three reel 100 and cable 140 (FIGS. 2, 3 and 5) assemblies or combinations is selected. These three reels will be respectively wound with the light workout cable 140*l*, the medium workout cable 140*m*, or the heavy workout cable 140*h* (FIG. 8). For this purpose, the reel-cable assembly not wanted is removed from the bottom filler block 72 and the desired reel and cable combination is inserted into the position above described.

It is be understood that the exercise apparatus 20 may be initially supplied with only the reel 100-cable 140 assembly immediately desired and that additional or different reel-cable assemblies may be acquired later depending on the workout level subsequently desired. Alternatively, the apparatus may be initially acquired with several different reel-cable assemblies so that different workout levels are immediately available for one or several persons.

In the preferred embodiment described above, there is an outer briefcase, or more generally a case, as 22, enclosing or housing inner filler blocks 70 and 72 and the reel 100-cable 140 assembly. A modified embodiment, not shown, is that the filler blocks are provided with hinges, not shown but like hinges 28 and latches 46, or other releasable fastening members, so that the blocks become the container or case for the reel-cable assembly and no other outer case, as 22, is used.

Figure 9:
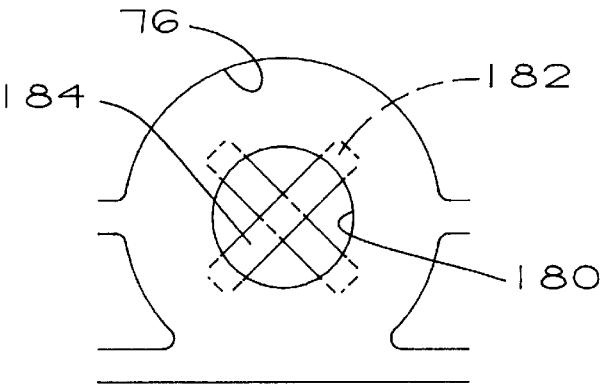
FIG. 9 is a fragmentary detailed plan view of an alternate feature of the present invention.

An optional feature of the subject apparatus 20 is shown in FIG. 9. With this feature, a countersunk subrecess 180 is provided concentric with the central recess 76 in the bottom filler block 72, and diametrically opposed pockets 182 open into the subrecess. Overlapping upwardly arcuate leaf springs 184 are positioned in the subrecess and have ends which slideably fit in the pockets. In use of this feature, the reel 100 rests on the junction of the overlapping leaf springs so that when the briefcase 22 is closed, the disc brake 120, in pressing down on the reel, compresses the leaf springs and the latter assists in holding the reel in position. Although experience shows that this feature may not be required, it is available if additional holding force appears to be needed in particular applications.

The portable exercise apparatus 20 (FIGS. 1–6) of the present invention provides exercises for all of the major muscle groups of the human body, including muscle groups in the shoulders, back, arms, chest, legs, abdominals, and calves. In all, at least fifty-five different exercises are possible to perform with the subject apparatus. To illustrate how the exercise apparatus is used to perform these exercises and to describe other steps of the method of the present invention, reference is now made to FIGS. 10–16. It is assumed that the exerciser, in acquiring the apparatus, selects the reel 100-cable 140 assembly suitable to the person's physical condition and desired workout level and inserts the reel-cable assembly in the bottom filler block 72 in the manner described above.

Figure 10:
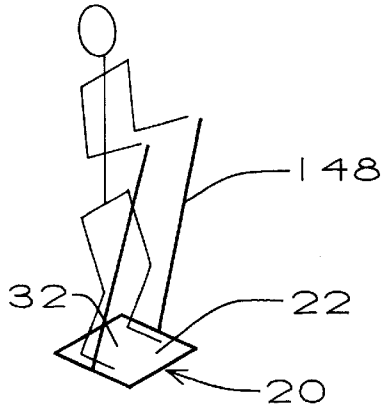
FIGS. 10 through 16 are schematic views illustrating certain steps involved in performing the method of exercise of the present invention using the subject portable exercise apparatus.
Figure 12:
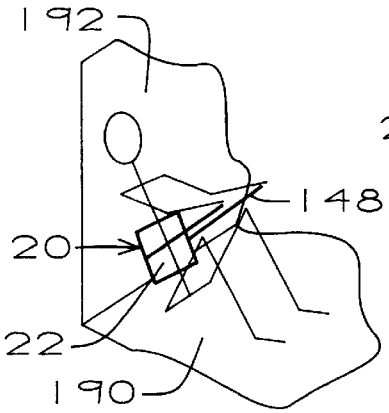
Figure 13:
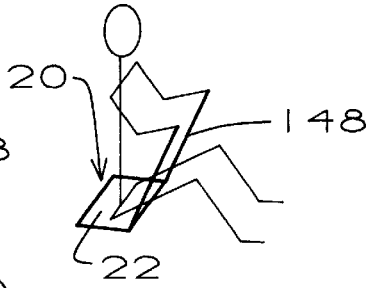
Figure 14:
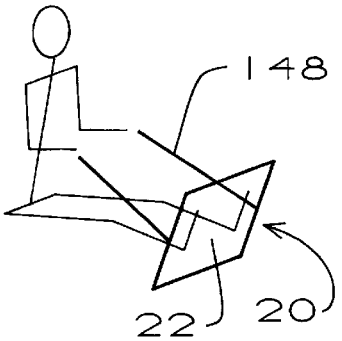

In general, the subject apparatus 20 and a person performing exercises with it (FIGS. 10–16) will be in one of several basic positions, namely, Position A. The briefcase case 22 lying flat on the floor with the bottom wall 34 against the floor, preferably next to a wall, and the person standing with both feet on the top wall 32 of the case (FIG. 10);

Position B. The case 22 lying flat on the floor 190 next to a wall 192 and the exerciser standing with one foot on the case and one foot on the floor (FIG. 11) or kneeling on the floor with one hand on the case and one knee on the case;

Position C. The case 22 against the small of the back and the person in a sitting position on the floor, preferably next to a wall (FIG. 12);

Position D. The case 20 lying flat on the floor as before and the exerciser sitting on the top wall of the case (FIG. 13);

Position E. The case 22 in an upwardly tilted position and the exerciser in a sitting position on the floor with the feet against the case and the back to the wall (FIG. 14);

Position F. The case 22 on one side of a door 194, which is either closed or held against movement, the cables 140 under the door, and the exerciser on the other side of the door in either a sitting position on the floor, as shown, or in a chair, not shown (FIG. 15); and Position G. The case 22 on one side of a door 194 and the cables 140 under the door, as in Position F, while the exerciser is on the opposite side of the door and lying, kneeling, or standing on the floor (FIG. 16).

Figure 15:
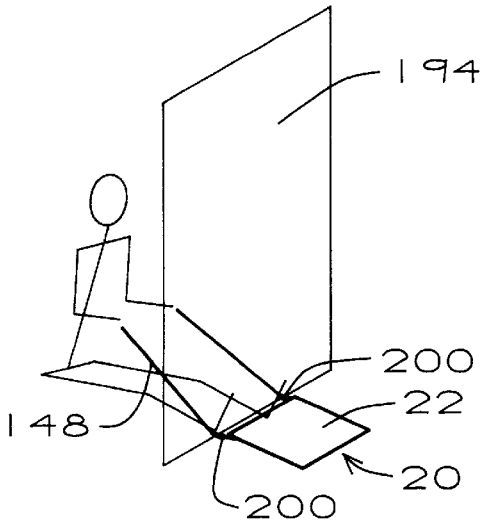
Figure 16:
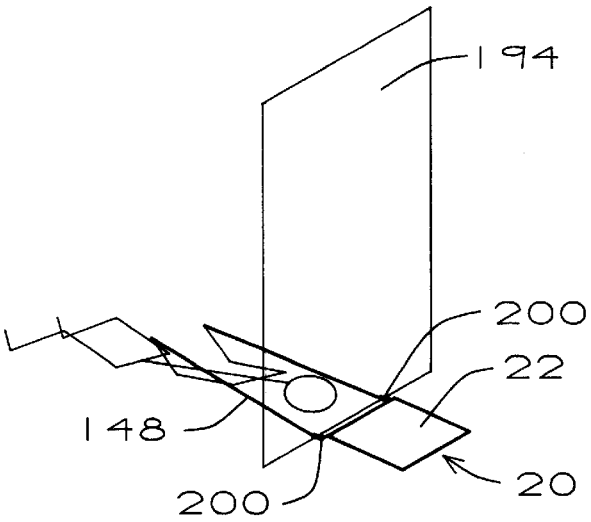

In Positions F and G, which use the subject apparatus 20 with a door, it is preferable to use wear-resistant sleeves, indicated at 200 in FIGS. 15 and 16, around the cables and through which the cables can slide, thereby to avoid undue wear on the cables 140 and the door and to facilitate movement of the cables relative to the bottom edge of the door.

The many exercises which can be performed on the subject apparatus 20 will now be described in greater detail by specific reference to FIGS. 10–16, having in mind the several basic exercise positions described above. The exercises referred to are well-known standard exercises and thus their names are written with initial capitals.

Position A. The briefcase case 22 lying flat on the floor with the bottom wall 34 against the floor preferably next to a wall and the person standing with both feet on the top wall 32 of the case FIG. 10)

The exercise being performed in FIG. 10 is an Upright Row which benefits the following primary muscle groups: deltoids, middle posterior and anterior, trapezius, and sternocleidomastoid. As shown, the exerciser stands on the case 22, grasps the handles 160 and pulls and releases the cables 140 to perform the exercise. As is believed understood and in all the exercises, the cables 140 exit the case 20 through the front notches 60. The following other exercises can also be performed in this position: for the shoulders—Shoulder Shrug, Crossover Shoulder Raise, and Reverse Shoulder Shrug; for the back—Lower Back Extension; for the arms—Bicep Curl, Reverse Curl, and Wrist Extension; and for the calves—Heel Raise.

Figure 11:
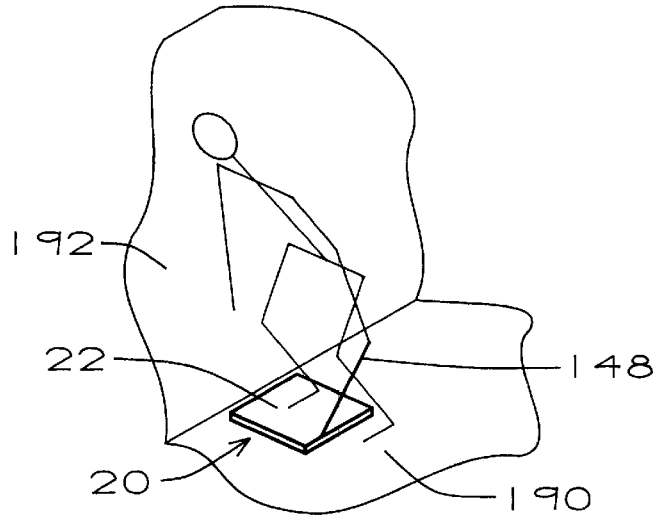

Position B. The case 22 lying flat on the floor 190 next to a wall 192 and the exerciser standing with one foot on the case and one foot on the floor (FIG. 11) or kneeling on the floor with one hand on the case and one knee on the case The exercise being illustrated in FIG. 11 is the Forehand Swing which benefits the following primary muscle groups of the shoulders: middle and posterior deltoids, teres groups, triceps, supinators, and wrist extensions. The exerciser grasps the handle 160 at the end of the case toward which the exerciser is facing and with the hand farther from the wall. While holding the case against movement with one foot on it, the hand grasping the handle pulls the cable toward and away from the case to achieve the desired isometric exercise. Other exercises that can be performed in this position are: for the chest—the Forehand Swing; for the arms—the Concentration Curl and Tricep Kickback; for the abdominals—the Side Bend; and for the shoulders—the Backhand Swing.

Position C. The case 22 against the small of the back and the person in a sitting position on the floor, preferably next to a wall (FIG. 12)

The exercise illustrated in FIG. 12 is the Bench Press which is designed to benefit the following primary muscle groups of the chest: pectoralis major, anterior deltoid, and triceps. The handles 160 are grasped and the cables 140 are pulled outward and then relaxed to achieve the desired exercising action. The following exercises are also possible in this position: for the chest—the Chest Fly, the Incline Press, and the Decline Press; for the arms—the Seated Abdominal Crunch and the Tricep Cross Press; for the shoulders—the Front Shoulder Raise; and for the arms—the Tricep Cross Press, and the Tricep Press.

Position D. The case 20 lying flat on the floor as before and the exerciser sitting on the top wall of the case (FIG. 13);

The exercise being illustrated in FIG. 13 is called the French Press and is performed to benefit the triceps of the arms. The exerciser sits on the briefcase, facing away from the wall, with the knees bent and the feet flat on the floor. Then, the exerciser grasps one or both of the handles 160 and applies tension to one or both of the cables, as the case may be. Other exercises that may be performed in this position are: for the shoulders—the Shoulder Press, Inward Fly Rotation, Outward Fly Rotation, Backhand Drive, and Front Shoulder Raise; and for the chest—the Resisted Punch.

Position E. The case 22 in an upwardly tilted position and the exerciser in a sitting position on the floor with the feet against the case and the back to the wall (FIG. 14);

The exercise being illustrated in FIG. 14 is called the Seated Row and is primarily to benefit the following muscle groups: deep posture muscles of the back and upper muscles. Here the case 22 is tilted against the wall, and the exerciser is sitting on the floor with the feet against the case. The handles 160 are grasped and the cables 140 are pulled and released to apply and relieve tension. Other exercises that can be performed in this position are: for the shoulders—the Flying Shoulder Raise, the Reverse Fly, the Back Shoulder Extension, and the Lying Shoulder Raise; for the back—the One Arm Row and the Cross Body Row; for the arms—the Seated Curl and the Wrist Curl; for the legs—the Lying Leg Extension.

Position F. The case 20 on one side of a door 194, which is either closed or held against movement, the cables 140 under the door, and the exerciser on the other side of the door in either a sitting position on the floor, as shown or in a chair, not shown (FIG. 15)

In FIG. 15, the exercise being illustrated is called the Forehand Drive and is performed to benefit the following primary muscle groups of the arms: pectoralis major, anterior deltoid, biceps, pronators, and wrist flexors. While sitting on the floor facing the door and with the knees bent and one or both of the handles 160 are grasped. While resting the lower arms on the legs, the fingers and the hands are curled toward the forearm, thereby applying tension to the cables 140. Many other exercises can be performed in this position including: for the legs—the Hip Flexor, the Back Leg Extension, the seated Leg Adduction, the Side Leg Extension, and the Seated Leg Abduction; for the calves—the Ankle Abduction and the Ankle Adduction; and for the Abdominals—the Abdominal Twist, the Lower Abdominal Pull, and the Seated Abdominal Crunch.

Position G. The case 20 on one side of a door 194 and the cables 140 under the door, as in Position F, while the exerciser is on the opposite side of the door and lying, kneeling, or standing on the floor(FIG. 16).

The exercise being illustrated in FIG. 16 is the popular Lat Pull-Down which is performed to benefit the following primary muscle groups in the back: the pectoralis major, the latissimus dorsi, the rhomboids, the anterior and posterior deltoids and the biceps. The handles 160 are grasped with the palms facing up and the hands are moved from a position overhead to a position at about shoulder level and then returned, thereby placing the cables under tension and relieving this tension. Other exercises that can be performed in this position are: for the arms—the Tricep Push Down; for the chest—the Shoulder Pull Over; for the back—the Shoulder Fly; and for the legs—the Lying Leg Curl, and the Hip Extension; for the abdominals—the Resistance-Aided Abdominal Curl, and the Resistance-Aided Abdominal Crunch.

From the foregoing, it will be understood that at least fifty-five exercises can be performed with the subject portable exercise apparatus 20. Moreover, these exercises replicate the exercises that are normally performed on the popular BOWFLEX stationary workout apparatus referred to above. Thus, it becomes possible with the present invention for a person to maintain a regular workout plan even while traveling and away from the home-or health club-based unit.

The apparatus 20 is easy to use, carry, check-in, or store, and otherwise is compatible with ordinary luggage and in fact in the preferred embodiment externally looks like a standard briefcase or luggage. The device has the strength necessary for performing the many exercises described and yet is relatively light, less than about ten to fifteen pounds in the preferred embodiment. The invention provides for several optional strength levels, three in the preferred embodiment, and these are easy to change as desire. The apparatus is of relatively simple and durable construction without complicated multiple pulleys, cables and springs, or the like, and thus is economical and trouble-free from the standpoint of manufacture and maintenance.

Although a preferred embodiment of the present invention has been shown and described, various modifications and substitutions may be made thereto without departing from the spirit and scope of the invention. Accordingly, it is to be understood that the present invention has been described by way of illustration and not limitation.

What is claimed is:

1. An exercise apparatus, comprising:

container means;

cable storing means positioned within the container means;

elastic cable means attached to said storing means for movement between a stowed position within the container means and an exercising position having an outer portion outside the container means and an inner portion in the container means, said cable means remaining attached to the cable storing means in both said stowed and exercising position; and means operable in said exercising position for permitting essentially only said outer portion to be alternately stretched and relaxed while said inner portion remains in substantially relaxed condition, thereby to enable exercises to be performed with said outer portion.

2. The apparatus of claim 1, wherein said container means has open and closed positions, and wherein said operable means is operated in cooperation with closing of the container means to limit stretching of said inner portion.

3. The apparatus of claim 1, wherein said cable storing means is rotatably mounted within the container means, wherein said cable means is windably attached to the cable storing means for allowing predetermined lengths of such outer portion to be unwound from said mounting means and extended outwardly from the container means in an unstretched condition prior to stretching and relaxing of said outer portion, and wherein said operable means limits rotation of the mounting means in said exercising position.

4. The apparatus of claim 3, wherein the mounting means is a pulley releasably rotatably mounted in the container means.

5. The apparatus of claim 4, wherein said operable means is a brake mounted in the container means for engaging the pulley to preclude rotation of the pulley in said exercising position.

6. The apparatus of claim 3, wherein:

said operable means includes means for setting the length of said outer portions when the outer portions are in unstretched condition and in said exercising position.

7. The apparatus of claim 1, wherein the container means has open and closed positions, wherein said elastic cable means is on the cable storing means and completely within the container means in said stowed position, wherein the inner portion of the cable means is on the cable storing means and within the container means in said exercising position, and wherein said cable storing means and said cable means cooperate to allow said outer portion of the cable means to be extended outwardly of the container means a predetermined length and in relaxed condition prior to stretching and relaxing for purposes of exercise.

8. The apparatus of claim 1, wherein the cable means includes an elastic cable having a stretchability characteristic selected from the group consisting of high and low stretchability and a medium stretchability between said high and low stretch abilities, depending on the strength level of the exerciser, and wherein said storing means and cable means are removably mounted in the container means to enable the strength level of the apparatus to be changed and so that when in the container means the outer portion of the cable means can be extended into said exercising position while the inner portion remains on the stowing means and in the container means.

9. The apparatus of claim 8, wherein said cable is a tubular cable having a wall thickness selected from the group consisting of a relatively thin wall thickness, a relatively thick wall thickness and a medium wall thickness between the other two thicknesses.

10. The apparatus of claim 1, wherein the cable means includes a pair of cables extending out from opposite sides of the container means in said exercising positions.

11. The apparatus of claim 1, wherein said container means includes an outside case having the size, shape, and external appearance of a briefcase and an inside case of a size and shape to closely fit in the outside case, said storing means is mounted within the inside case.

12. An exercise apparatus, comprising a container having open and closed positions and top and bottom walls each connected to a rigid circumferential rim and which are in spaced, substantially parallel relation when the container is closed, said container having a side;

means for maintaining the spaced relation of said walls in said closed position so that the container is strong and firm enough to support an exerciser without collapsing when the exerciser exerts pressure on said top wall;

cable means including at least one elastic cable;

means for windably mounting the cable means in the container so that said at least one elastic cable can be payed out from the side of the container and into exercise position extending outwardly from the container or wound into the container into a stowed position within the container; and means for restraining the portion of the cable remaining wound and in the container from stretching when the container is closed and the cable is in its exercising position so that essentially only the portion of the cable extending outwardly from the container can be stretched.

13. The apparatus of claim 12, wherein said maintaining means are blocks of solid material fitted in the container against the top and bottom walls and engaging each other when the container is closed, wherein one of said blocks has recessed means therein for receiving the cable means and the windably mounting means.

14. The apparatus of claim 12, wherein said at least one elastic cable is tubular.

15. The apparatus of claim 12, wherein said windably mounting means is a reel with two sheaves;

wherein said cable means comprises a pair of elastic cables respectively attached to and wound around the sheaves; and wherein said reel and cables are removably mounted in the container for enabling cables with different stretch characteristics to be used thereby to vary the strength level of the exercises to be performed.

16. An exercise apparatus, comprising:

a container having rectangular top and bottom sections relatively movable between open and closed positions of the container and being latchable in closed position, said top and bottom sections respectively having top and bottom walls, and front, back and side walls projecting from the top and bottom walls and interengaging in said closed position, said walls of each section defining a rectangular cavity in the section;

top and bottom rigid fillers complementary in size to said top and bottom sections and respectively releasably fitted in the cavities of said top and bottom sections so that they fill their respective sections between the front, side and back walls, said bottom filler having a central circular recess, a pair of handle recesses on opposite sides of the central recess, and slots interconnecting said recesses and opening laterally of the bottom filler at the side walls of the bottom section;

a reel releasably rotatably mounted in the central recess and including top and bottom sheaves;

a brake positioned on and stationary relative to the top filler and being in opposed engagement with the reel when the top and bottom sections are closed, said reel and brake having interengaging portions precluding rotation of the reel when the container is closed;

elastic cables individually wrapped in the same direction around the sheaves having inner ends connected to the reel and outer ends; and handles connected to the outer ends of the cables, said cables having stowed positions within the bottom section wherein the cables are almost fully wrapped around the reel, the handles are fitted in the handle recesses on their respective sides of the container, and the portions of the cables off the reel are fitted in the slots, so that in said stowed position, the reel, cables and handles are entirely within the plane of the bottom filler and section and within the container, said cables also having exercising positions wherein outer portions of the cables extend outside the container and inner portions still remain on the reel and extend therefrom to the sides of the container, and whereby in said exercising positions of the cables and with the container closed, the outer portions of the cables can be stretched and relaxed between the container and said outer ends while the interengaging brake and reel limit stretching of said inner portions of the cables between the sides of the container and the reel, so that predetermined lengths of such outer portions can be payed out from said reel and then stretched and relaxed relative to the container for performing exercises.

17. The apparatus of claim 16, wherein:

said fillers are made of a hard plastic and are engageable with each other and with the top and bottom walls of the top and bottom sections of the container when the container is closed so as to provide a solid foundation capable of supporting an exerciser in exercising position thereon.

18. The apparatus of claim 16, further including:

spring means in the central recess for resiliently pressing the reel against the brake in the closed position of the container.

19. The apparatus of claim 16, wherein:

the side walls of at least one of the top and bottom sections have notches which are in alignment across the section from each other, said outer portions of the cables respectively fitting in said notches when they are in the exercising positions.

20. A method for performing exercises utilizing a container having open and closed positions, cable mounting means in the container, and elastic cable means wound around the cable mounting means and selectively positionable entirely within the container or with an outer portion thereof extending outside of the container, comprising the steps of:

opening the container;

placing said outer portion of the cable means outside of the container while leaving an inner portion of the cable means in the container;

restraining stretching of the inner portion of the cable means within the container during exercising by closing the container with said outer portion remaining outside of the container; and pulling on said outer portion of the cable means while maintaining the container stationary relative to the point of application of the pulling force thereby to perform exercises.

21. The method of claim 20 wherein there are a plurality of combinations of cable mounting means and cable means for different strength levels of exercise, including the further steps of:

selecting one combination of cable mounting means and cable means for a desired strength level; and inserting the selected combination in the container while in open position.

22. The method of claim 20, wherein:

the container is held stationary during exercising by placing part of the leg of an exerciser on it in its closed position.

23. The method of claim 20, wherein:

the container is held stationary by the exerciser sitting on it in its closed position.

24. The method of claim 20, wherein:

the container is held stationary by placing it against the small of the back of the exerciser while in its closed position.

25. The method of claim 20, wherein the container is held stationary by placing it on one side of a stationary door in closed position while the exerciser is positioned on the opposite side of the door; and wherein said outer portion of the cable means is extended under the door.

26. An exercise apparatus, comprising:

container means;

cable storing means positioned within the container means;

elastic cable means attached to said storing means for movement between a stowed position within the container means and an exercising position having an outer portion outside the container means and an inner portion in the container means, said cable means remaining attached to the cable storing means in both said stowed and exercising position; and means operable in said exercising position for permitting essentially only said outer portion to be alternately stretched and relaxed while restraining stretching of said inner portion, thereby to enable exercises to be performed with said outer portion.

27. An exercise apparatus, comprising:

a container having open and closed positions, a reel rotatably mounted in the container, and an elastic cable wound about the reel for movement between a stowed position around the reel and within the container and an exercising position with an outer portion thereof outside of the container and an inner portion thereof around the reel and within the container, said container having means engageable with the cable when the cable is in its exercising position and the container is in its closed position for enabling essentially only the outer portion of the cable to be stretched and relaxed relative to the container, thereby to enable exercises to be performed.

28. A method for performing exercises utilizing a container having open and closed positions, cable mounting means in the container, and cable means wound around the cable mounting means and selectively positionable entirely within the container or with an outer portion thereof extending outside of the container, comprising the steps of:

opening the container;

placing said outer portion of the cable means outside of the container while leaving an inner portion of the cable in the container;

closing the container with said outer portion remaining outside of the container; and pulling on said outer portion of the cable means while maintaining the container stationary relative to the point of application of the pulling force and while maintaining the inner portion of the cable means in substantially relaxed condition, thereby to perform exercises.

* * * * *